US006528978B2

(12) United States Patent
Lim

(10) Patent No.: US 6,528,978 B2
(45) Date of Patent: Mar. 4, 2003

(54) REFERENCE VOLTAGE GENERATOR

(75) Inventor: Kyu-Nam Lim, Youngin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/988,657

(22) Filed: Nov. 20, 2001

(65) Prior Publication Data

US 2002/0153870 A1 Oct. 24, 2002

(30) Foreign Application Priority Data

Mar. 8, 2001 (KR) ..... 2001-12001

(51) Int. Cl.[7] ..... G05F 3/20; G05F 1/10
(52) U.S. Cl. ..... 323/313; 323/907; 327/538
(58) Field of Search ..... 323/313, 314, 323/315, 316, 907; 327/538, 539; 307/296

(56) References Cited

U.S. PATENT DOCUMENTS 4,325,017 A * 4/1982 Schade, Jr. ..... 323/313
5,146,152 A * 9/1992 Jin et al. ..... 323/56
5,309,083 A * 5/1994 Pierret et al. ..... 323/313
5,532,578 A 7/1996 Lee
5,796,244 A * 8/1998 Chen et al. ..... 323/313

* cited by examiner

*Primary Examiner*—Rajnikant B. Patel
(74) *Attorney, Agent, or Firm*—Lee & Sterba, P.C.

(57) ABSTRACT

A reference voltage generating circuit of the present invention includes a start-up circuit connected between a power supply voltage and a ground voltage for generating a start-up voltage, a bias current generating circuit connected between the power supply voltage and the ground voltage for generating a bias current in response to the start-up voltage, the bias current increasing in response to an increase in temperature, a current generator connected between the power supply voltage and a reference voltage generating terminal for generating a mirrored current of the bias current, and a load connected between the reference voltage generating terminal and the ground voltage for generating a reference voltage that increases in response to any increase in temperature regardless of variations in the level of the power supply voltage. Accordingly, the level of reference voltage generated increases in response to increases in temperature regardless of variations in the level of the power supply voltage.

7 Claims, 9 Drawing Sheets

REFERENCE VOLTAGE GENERATOR

BACKGROUND OF THE INVENTION

1. Field of the Invention

The present invention relates to a reference voltage generating circuit. More particularly, the present invention relates to a reference voltage generating circuit for generating a reference voltage that is highly stable against variations in power supply voltage and that increases relative to increases in operating temperature.

2. Description of the Related Art

Generally, a reference voltage generating circuit should be designed to generate stable reference voltages regardless of variations in power supply voltage and operating temperature.

However, a reference voltage generating circuit for generating a reference voltage that is not affected by variations in a power supply voltage and yet increases in response to increases in operating temperatures is required for semiconductor memory devices that have been developed for application in high speed devices.

A conventional semiconductor memory device has many peripheral circuit blocks that perform operations relying on the reference voltage generated by the reference voltage generating circuit. If the reference voltage of the semiconductor memory device is constant or decreased by temperature increment, the operating speed of the peripheral circuit blocks by the reference voltage can be delayed. Hence, there is a problem in that the operating speed of the semiconductor memory device may be delayed.

SUMMARY OF THE INVENTION

According to a feature of an embodiment of the present invention, there is provided a reference voltage generating circuit capable of generating a reference voltage that increases in response to increases in operating temperature regardless of changes in the power supply voltage.

According to a feature of an embodiment of the present invention, a reference voltage generating circuit includes a start-up circuit connected between a power supply voltage and a ground voltage for generating a start-up voltage, a bias current generating circuit connected between the power supply voltage and the ground voltage for generating a bias current that increases in response to increases in temperature due to the start-up voltage, a current generator connected between the power supply voltage and a reference voltage generating terminal for generating a mirrored current of the bias current, and a load connected between the reference voltage generating terminal and the ground voltage for generating a reference voltage that increases in response to increases in temperature regardless of increases in the power supply voltage.

DETAILED DESCRIPTION OF THE INVENTION

Korean Patent Application No. 2001–12001, filed Mar. 8, 2001, and entitled: "Reference Voltage Generator," is incorporated herein by reference in its entirety.

The present invention will now be described more fully hereinafter with reference to the accompanying drawings, in which preferred embodiments of the invention are shown. This invention may, however, be modified in different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

For a better understanding of the present invention, the operation of the conventional reference voltage generating circuit will be explained first before the present invention is described.

Figure 1:
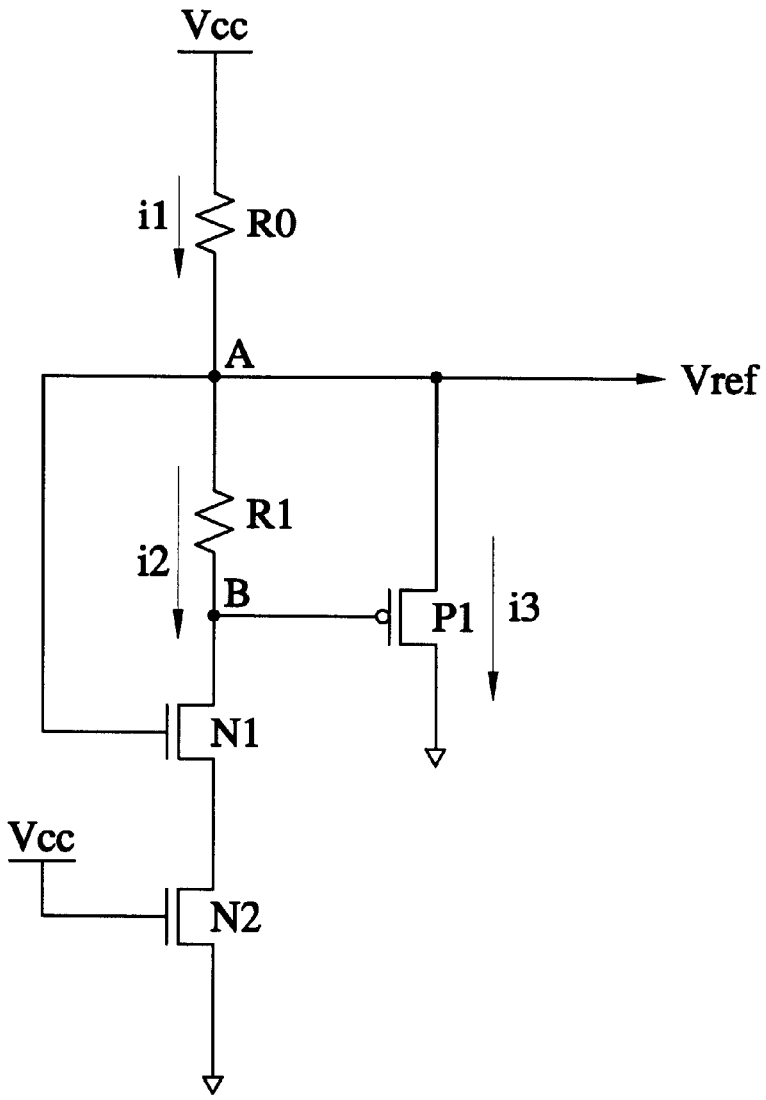
FIG. 1 (PRIOR ART)
FIG. 1 is a circuit diagram illustrating an embodiment of a reference voltage generating circuit according to the prior art.

FIG. 1 is a circuit diagram of an embodiment of a conventional reference voltage generating circuit, and includes a resistor (R0) connected between a power supply voltage (Vcc) and a node (A), a resistor (R1) connected between the node (A) and a node (B), NMOS transistors (N1, N2) connected serially between the node (B) and a ground voltage for receiving a voltage of the node (A) at a gate of the NMOS transistor (N1) and the power supply voltage (Vcc) at a gate of the NMOS transistor (N2), and a PMOS transistor (P1) having a gate connected to the node (B), a source connected to the node (A), and a drain connected to the ground voltage.

The operation of the reference voltage generating circuit shown in FIG. 1 is as follows.

Assuming that a current passing through the resistor (R0) is i1, a current passing through the resistor (R1) and the NMOS transistors (N1, N2) is i2, a current passing through the PMOS transistor (P1) is i3, a threshold voltage of the PMOS transistor (P1) is Vtp, and the resistor value by the NMOS transistors (N1, N2) is R2, the operation of the reference voltage generating circuit shown in FIG. 1 can be expressed as equation (1) since i1 is sum of i2 and i3.

$$\frac{(VCC - Vref)}{R0} = \frac{Vref}{(R1 + R2)} + \frac{\beta_0}{2}\left(\frac{R1}{(R1 + R2)}Vref - |Vtp|\right)^2 \qquad (1)$$

In equation (1), $\beta_0$ indicates gain of the PMOS transistor (P1).

Equation (2) is obtained by differentiating both sides of equation (1) with respect to the power supply voltage (Vcc).

$$\frac{1}{R0} - \frac{1}{R0}\frac{\partial Vref}{\partial VCC} = \frac{1}{R1+R2}\frac{\partial Vref}{\partial VCC} + \beta_0\left(\frac{R1}{R1+R2}Vref - |Vtp|\right)\frac{R1}{R1+R2}\frac{\partial Vref}{\partial VCC} \quad (2)$$

The variation of the reference voltage (Vref) with respect to the variation of the power supply voltage (Vcc) can be expressed as equation (3) as desired from equation (2).

$$\frac{\partial Vref}{\partial VCC} = \frac{R1+R2}{R0+R1+R2+\beta_0 R0R1\left(\frac{R1}{R1+R2}Vref - |Vtp|\right)} \quad (3)$$

As known from equation (3), the conventional reference voltage generating circuit shown in FIG. 1 can have a large value of denominator by the multiplication of the resistors (R0, R1). Hence, it is possible to minimize the variation of the reference voltage (Vref) with respect to the variation of the power supply voltage (Vcc).

Assuming that both $$\frac{\partial R0}{\partial T} \text{ and } \frac{\partial R1}{\partial T}$$

are zero, the variation of the reference voltage (Vref) with respect to the variation of a temperature (T) can be expressed as equation (4) by differentiating both sides of equation (1) with respect to the temperature (T).

$$-\frac{1}{R0}\frac{\partial Vref}{\partial T} = \frac{\partial Vref}{\partial T}\frac{1}{R1+R2} + Vref\frac{\partial}{\partial T}\left(\frac{1}{R1+R2}\right) + \beta_0\left(\frac{R1}{R1+R2}Vref - |Vtp|\right)\times\left(\frac{\partial Vref}{\partial T}\frac{R1}{R1+R2} + Vref\frac{\partial}{\partial T}\left(\frac{R1}{R1+R2}\right) - \frac{\partial |Vtp|}{\partial T}\right) \quad (4)$$

Equation (5) is obtained by rearranging equation (4).

$$\frac{\partial Vref}{\partial T}\left(\frac{1}{R0} + \frac{1}{R1+R2} + \frac{0.1\beta_0 R1}{R1+R2}\right) = \frac{\partial R2}{\partial T}\left(\frac{Vref}{(R1+R2)^2} + \frac{0.1\beta_0 R1 Vref}{(R1+R2)^2}\right) + 0.1\beta_0\frac{\partial |Vtp|}{\partial T} \quad (5)$$

The resistor (R2) of equation (5) can be expressed as follows, $$R2 \approx \frac{1}{\mu Cox\left(\frac{W}{L}\right)(Vgs - Vtn - Vds)} \quad (6)$$

where Vtn is a threshold voltage of the NMOS transistor (N1), $\mu$ is a mobility, and Cox is a gate capacitance. Since $$\mu \text{ is } \mu_0\left(\frac{T}{T0}\right)^{-1.5},$$

the variation of the resistor (R2) with respect to the variation of the temperature (T) can be expressed as equation (7).

$$\frac{\partial R2}{\partial T} = R2\frac{1.5}{T0}\left(\frac{T}{T0}\right)^{-2.5} \quad (7)$$

Also, the variation of the reference voltage (Vref) with respect to the variation of the temperature (T) can be expressed as equation (8) by substituting equation (7) for equation (5).

$$\frac{\partial Vref}{\partial T} \approx -5.05\times 10^{-4} \quad (8)$$

As known from equation (5), the term inversely proportional to the temperature (T) by the threshold voltage (Vtp) and the term proportional to the temperature (T) by the resistor (R2) are added with each other. Hence, the variation of the reference voltage (Vref) with respect to the variation of the temperature (T) can be reduced.

However, the term inversely proportional to the temperature (T) by the threshold voltage (Vtp) is generally designed to be larger than the term proportional to the temperature (T) by the resistor (R2). Since the reference voltage (Vref) increases in response to increases in the resistor value of resistor (R2), it is not possible to design a resistor (R2) having a very large resistor value. Accordingly, the reference voltage (Vref) decreases as the temperature (T) increases. The reference voltage generating circuit shown in FIG. 1 maintains a stable reference voltage (Vref) regardless of the variation of the power supply voltage (Vcc), but there is a problem in that the reference voltage (Vref) decreases as the temperature (T) increases.

Figure 2A:
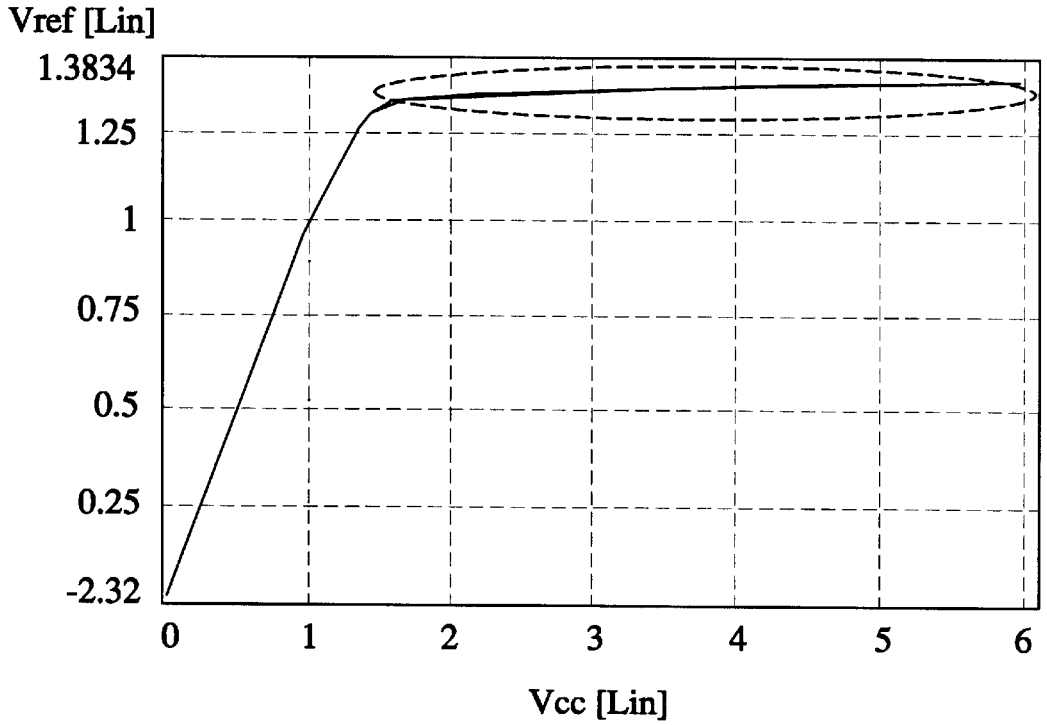
FIG. 2A (PRIOR ART)
FIGS. 2A and 2B are simulated graphs illustrating variations of reference voltages according to variations in temperature and power supply voltage of the reference voltage generating circuit shown in FIG. 1.
Figure 2B:
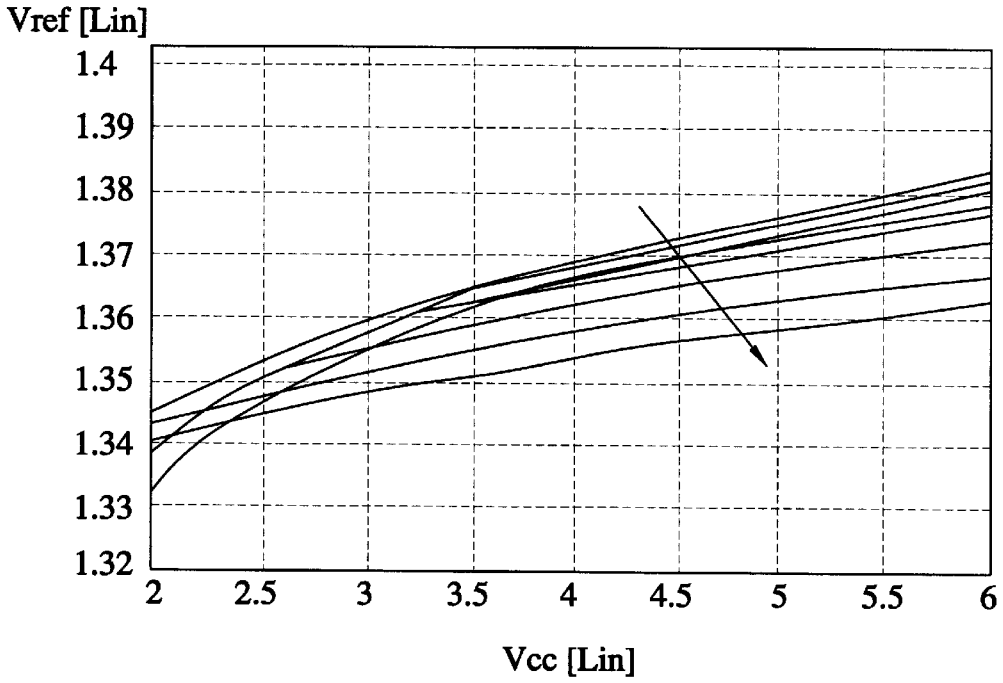
FIG. 2B (PRIOR ART)

FIGS. 2A and 2B are simulated graphs illustrating variations of the reference voltages according to variations in temperature and power supply voltage of the reference voltage generating circuit shown in FIG. 1.

FIG. 2A shows stable reference voltage (Vref) characteristics responding to increases in the power supply voltage (Vcc). FIG. 2B is a magnified graph of the dotted line portion of FIG. 2A, and an arrow in FIG. 2B indicates the direction of the reference voltage (Vref) in response to increases in temperature. From FIG. 2B, it may be understood that the reference voltage (Vref) decreases as the temperature (T) increases.

Figure 3:
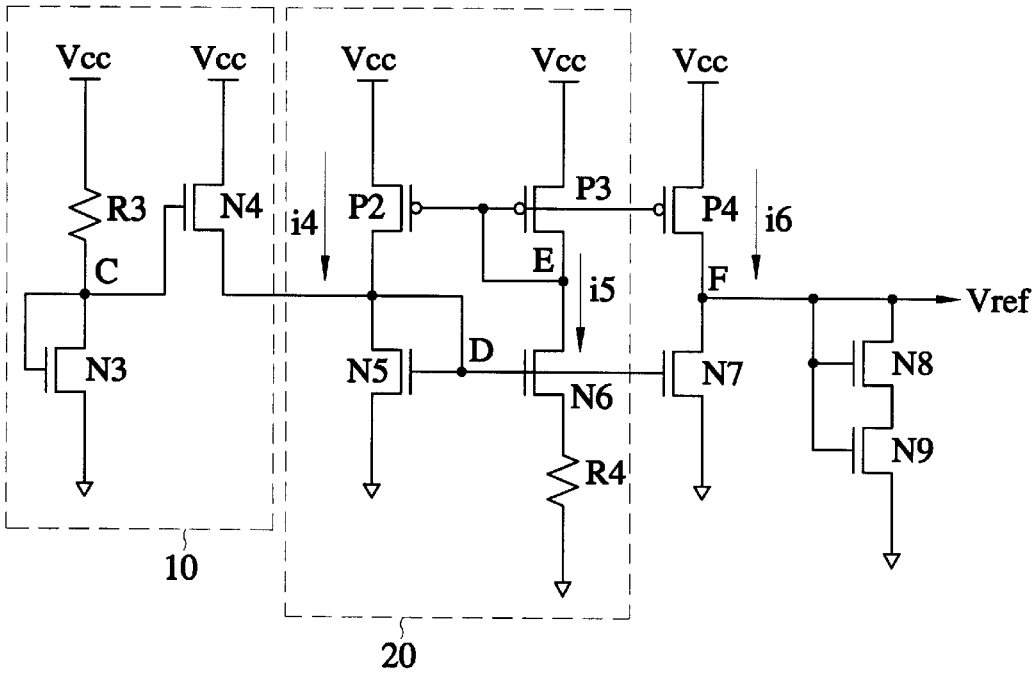
FIG. 3 (PRIOR ART)
FIG. 3 is a circuit diagram illustrating another embodiment of a reference voltage generating circuit according to the prior art.

FIG. 3 is a circuit diagram of another embodiment of a conventional reference voltage generating circuit, and includes a start-up circuit (10) comprised of a resistor (R3) and NMOS transistors (N3, N4), a bias current generating circuit (20) comprised of PMOS transistors (P2, P3), NMOS transistors (N5, N6), and a resistor (R4), a PMOS transistor (P4), and NMOS transistors (N7, N8, N9).

In the circuit shown in FIG. 3, the start-up circuit (10) includes the resistor (R3) connected between a power supply voltage (Vcc) and a node (C), the NMOS transistor (N3) connected between the node (C) and a ground voltage and having a gate connected to the node (C), and the NMOS transistor (N4) connected between the power supply voltage (Vcc) and a node (D) and having a gate connected to the node (C). The bias current generating circuit (20) includes the PMOS transistor (P2) and the NMOS transistor (N5) connected serially between the power supply voltage (Vcc) and the ground voltage and having gates connected to nodes (E, D, respectively) and the PMOS transistors (P3), the NMOS transistor (N6), and the resistor (R4) connected serially between the power supply voltage (Vcc) and the ground voltage. The PMOS transistor (P3) has a gate and a drain connected commonly to the node (E) and the NMOS transistor (N6) has a gate connected to the node (D). Also, a PMOS transistor (P4) and a NMOS transistor (N7) connected serially between the power supply voltage (Vcc) and the ground voltage have gates connected to the nodes (E, D, respectively), and NMOS transistors (N8, N9) connected serially between a node (F) and the ground voltage have gates connected commonly to the node (F).

The operation of circuit shown in FIG. 3 is as follows.

When the power supply voltage (Vcc) is applied, the voltage on the node (D) is determined to a predetermined level by the start-up circuit (10). Also, currents (i4, i5) in the bias current generating circuit (20) are determined by the predetermined level, and have the same value by the mirror characteristic of the bias current generating circuit (20). These currents (i4, i5) are also mirrored to a current (i6) of the PMOS transistor (P4) having the gate connected to the node (E).

Assuming that the current (i4) through the PMOS transistor (P2) is the same as the current (i5), the transistor gain of the NMOS transistor (N5) is $\beta_1$, the size of the PMOS transistor (P2) is the same as the PMOS transistor (P3), and the size of the NMOS transistor (N6) is $n^2$ times the size of the NMOS transistor (N5), the currents (i4, i5) can be expressed as equation (9).

$$i4 = i5 = \frac{1}{R4^2}\frac{2}{\beta_1}\left(1-\frac{1}{n}\right)^2 \quad (9)$$

From equation (9), the currents (i4, i5) increase since $\beta_1$, decreases as the temperature increases. Hence, the current (i6) through the PMOS transistor (P4) also increases, and the reference voltage generating circuit shown in FIG. 3 generates a reference voltage that increases as the temperature increases.

In equation (9), the currents (i4, i5) are shown as irrelevant to the power supply voltage (Vcc). This is because the variation of the currents (i4, i5) due to the channel length modulation is ignored. Actually, there is a problem in that the reference voltage (Vref) increases as the power supply voltage (Vcc) increases.

Figure 4A:
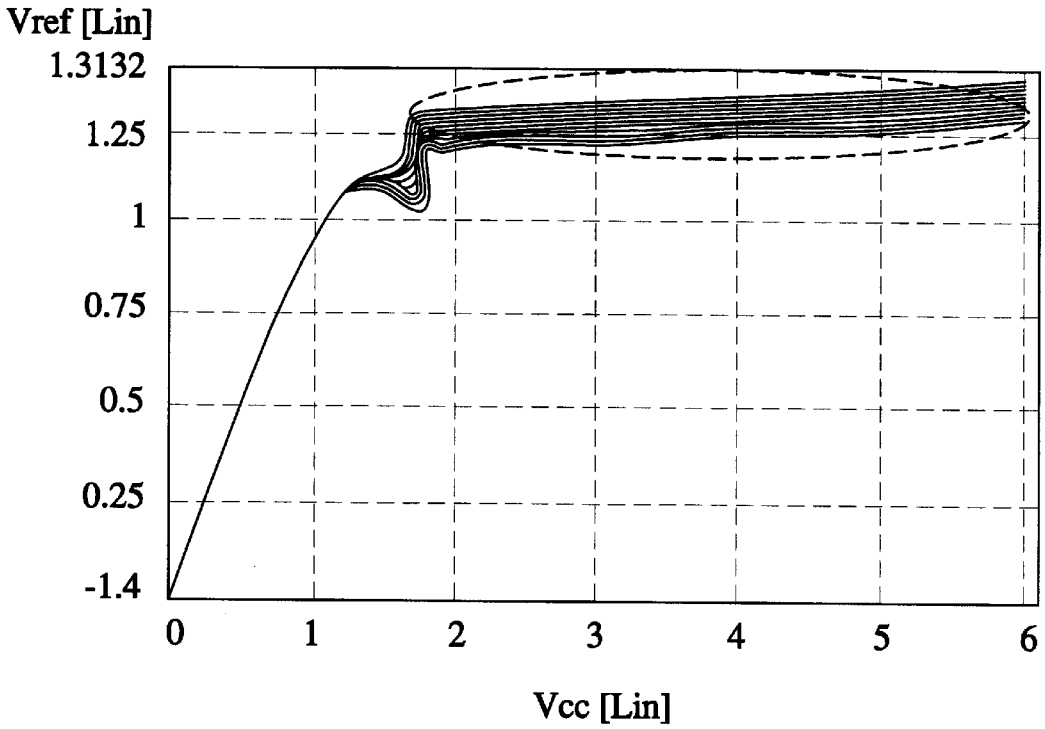
FIG. 4A (PRIOR ART)
FIGS. 4A and 4B are simulated graphs illustrating variations of reference voltages according to variations in temperature and power supply voltage of the reference voltage generating circuit shown in FIG. 3.
Figure 4B:
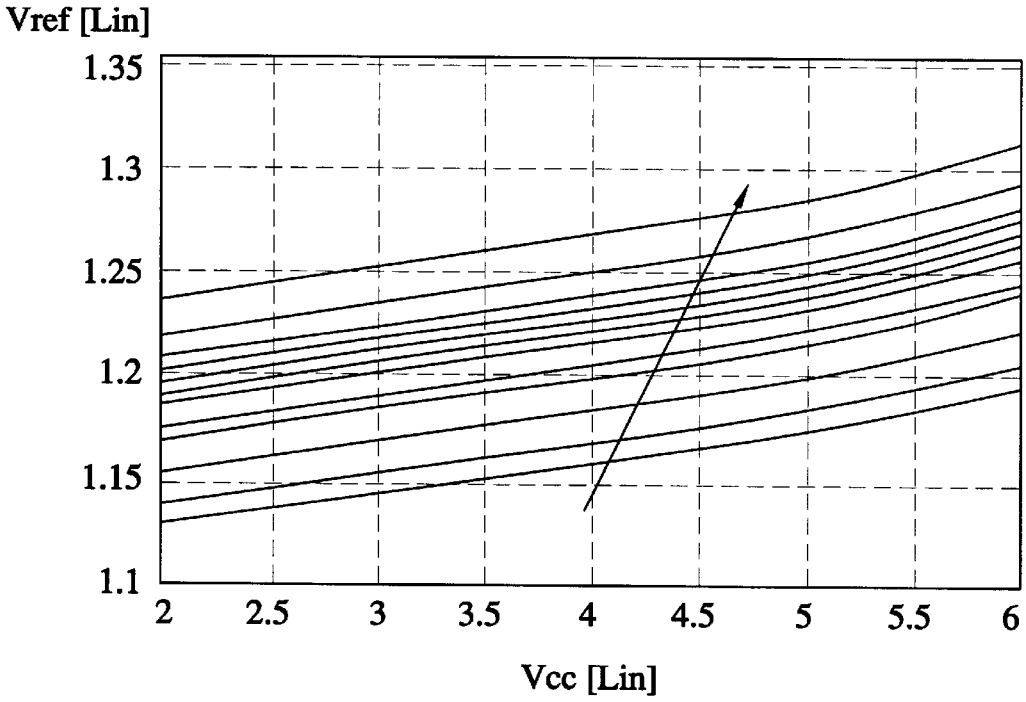
FIG. 4B (PRIOR ART)

FIGS. 4A and 4B are simulated graphs illustrating variations of the reference voltages according to variations in the temperature and power supply voltage of the reference voltage generating circuit shown in FIG. 3.

From FIG. 4A, it may be understood that the reference voltage (Vref) increases as the power supply voltage (Vcc) increases. FIG. 4B is a magnified view of the dotted line portion of FIG. 4A, and the arrow in FIG. 4B indicates the direction of the reference voltage (Vref) in response to an increase in temperature. From FIG. 4B, it may be understood that the reference voltage (Vref) increases as the temperature (T) increases.

Figure 5:
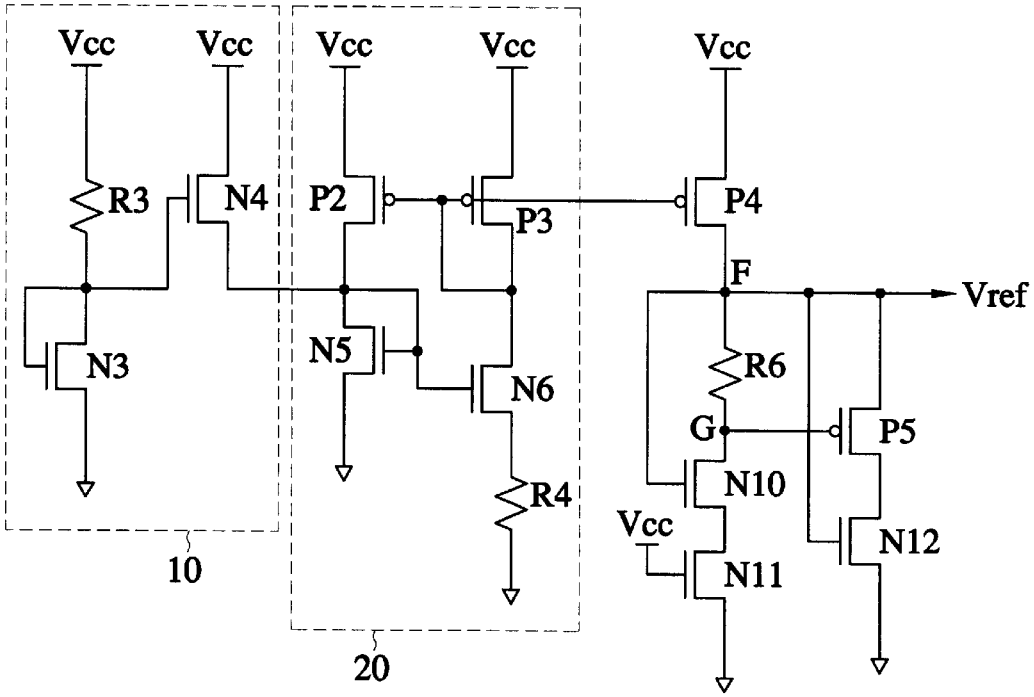
FIG. 5 is a circuit diagram illustrating an embodiment of a reference voltage generating circuit according to the present invention.

FIG. 5 is a circuit diagram of an embodiment of a reference voltage generating circuit according to the present invention. The reference voltage generating circuit includes a resistor (R6), NMOS transistors (N10, N11, N12), and a PMOS transistor (P5) by eliminating the NMOS transistors (N7, N8, N9) of the reference voltage generating circuit shown in FIG. 3.

The additional components in FIG. 5 are comprised of the resistor (R6) connected between node (F) and node (G), the NMOS transistors (N10, N11) connected serially between node (G) and the ground voltage and having gates connected to the reference voltage (Vref) and the power supply voltage (Vcc) respectively, and the PMOS transistor (P5) and the NMOS transistor (N12) connected serially between node (F) and the ground voltage and having gates connected to node (G) and the reference voltage (Vref), respectively.

The operation of the circuit shown in FIG. 5 is as follows.

The reference voltage (Vref) of the reference voltage generating circuit of FIG. 5 having the same configuration as the reference voltage generating circuit of FIG. 3 increases as the temperature increases. Additionally, the operation of additional components in FIG. 5 is identical to the operation of the reference voltage generating circuit in FIG. 1—the PMOS transistor (P4) of FIG. 5 corresponds to the resistor (R0) of FIG. 1, and the configuration of the resistor (R6), the NMOS transistors (N10, N11), and the PMOS transistor (P5) of FIG. 5 corresponds to the configuration of the resistor (R1), the NMOS transistors (N1, N2), and the PMOS transistor (P1) of FIG. 1. Hence, the reference voltage generating circuit of FIG. 5 generates a stable reference voltage (Vref) relative to any power supply voltage (Vcc) variation. The NMOS transistor (N12) operates as a resistor to reduce the current through the PMOS transistor (P5).

Hence, the reference voltage generating circuit of the present invention generates a reference voltage (Vref) that increases as the temperature increases regardless of increases in the power supply voltage (Vcc).

Figure 6A:
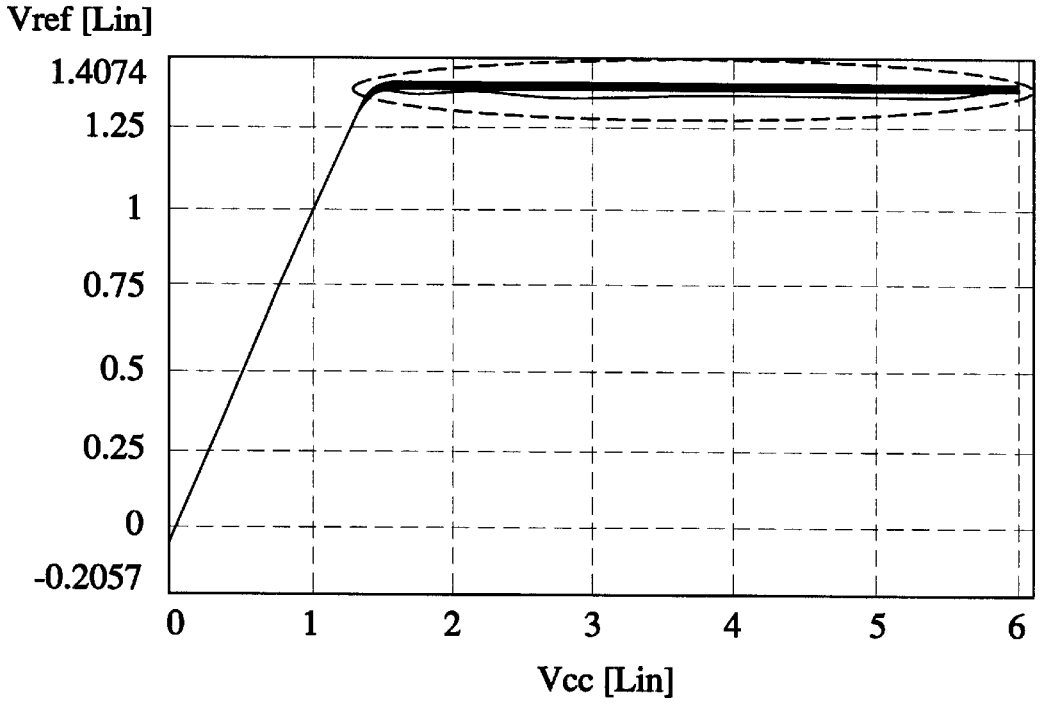
FIGS. 6A and 6B are simulated graphs illustrating variations of reference voltages according to variations in temperature and power supply voltage of the reference voltage generating circuit shown in FIG. 5.
Figure 6B:
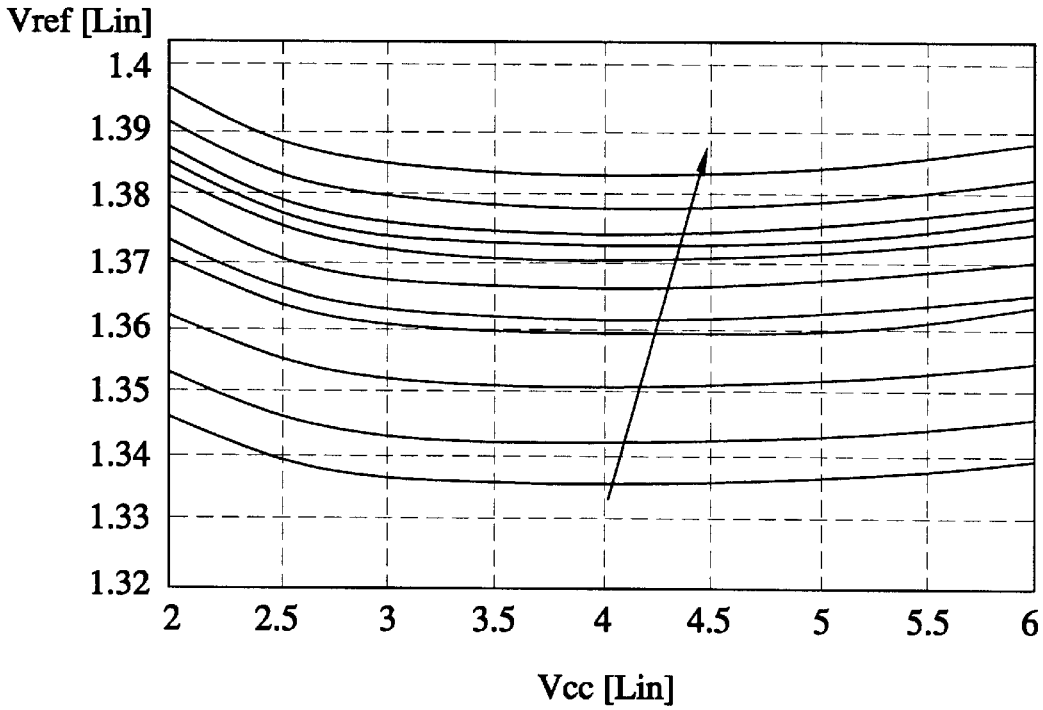

FIGS. 6A and 6B are simulated graphs illustrating variations of the reference voltages according to variations in the temperature and power supply voltage of the reference voltage generating circuit shown in FIG. 5.

From FIG. 6A, it may be understood that the reference voltage (Vref) is stable as the power supply voltage (Vcc) increases. FIG. 6B is a magnified view of the dotted line portion of FIG. 6A, and the arrow in FIG. 6B indicates the direction of the reference voltage (Vref) in response to an increase in temperature. From FIG. 6B, it may be understood that the reference voltage (Vref) increases as the temperature (T) increases.

As described above, according to the present invention, it is possible to generate a reference voltage that is stable to variations in the level of power supply voltage and yet that increases as the temperature (T) increases. Accordingly, the reference voltage generating circuit of the present invention as adapted to high speed semiconductor devices can improve the reliability of these devices.

The foregoing description of the present invention has been presented, using specific terms, for purposes of illustration and description. Numerous modifications and variations of the present invention are possible in light of the above teachings. It is therefore to be understood that, within the scope of the appended claims, the present invention can be practiced in a manner other than as specifically described herein.

What is claimed is:

1. A reference voltage generating circuit comprising:

a first current generating means connected between a power supply voltage and a ground voltage for generating a bias current that increases in response to increases in temperature;

a second current generating means connected between the power supply voltage and a reference voltage generating terminal for generating a mirrored current of the bias current; and a load connected between the reference voltage generating terminal and the ground voltage for generating a reference voltage that increases in response to increases in temperature regardless of increases in the power supply voltage, wherein the load includes:

a first resistor, first and second NMOS transistors connected serially between the reference voltage generating terminal and the ground voltage, for receiving the reference voltage at a gate of the first NMOS transistor and for receiving the power supply voltage at a gate of the second NMOS transistor; and a first PMOS transistor and a third NMOS transistor connected serially between the reference voltage generating terminal and the ground voltage, for receiving a voltage of a common node of the first resistor and the first NMOS transistor at a gate of the first PMOS transistor and the reference voltage at a gate of the third NMOS transistor.

2. A reference voltage generating circuit as claimed in claim 1, wherein the first current generating means comprises:

a start-up circuit connected between the power supply voltage and the ground voltage for generating a start-up voltage; and a bias current generating circuit connected between the power supply voltage and the ground voltage for generating the bias current in response to the start-up voltage.

3. A reference voltage generating circuit as claimed in claim 2, wherein the bias current generating circuit comprises:

a second PMOS transistor and a fourth NMOS transistor connected serially between the power supply voltage and the ground voltage, for receiving a voltage of a first node at a gate of the second PMOS transistor and the start-up voltage at a commonly connected gate and drain of the fourth NMOS transistor; and a third PMOS transistor, a fifth NMOS transistor, and a second resistor connected serially between the power supply voltage and the ground voltage, for receiving the voltage of the first node at a commonly connected gate and drain of the third PMOS transistor and the start-up voltage at a gate of the fifth NMOS transistor, wherein the bias current is generated through the third PMOS transistor.

4. A reference voltage generating circuit as claimed in claim 1, wherein the second current generating means comprises a fourth PMOS transistor for mirroring the bias current.

5. A reference voltage generating circuit comprising:

a start-up circuit connected between a power supply voltage and a ground voltage for generating a start-up voltage;

a bias current generating circuit connected between the power supply voltage and the ground voltage for generating a bias current in response to the start-up voltage, the level of bias current increasing in response to an increase in temperature;

a current generator connected between the power supply voltage and a reference voltage generating terminal for generating a mirrored current of the bias current; and a load connected between the reference voltage generating terminal and the ground voltage for generating a reference voltage that increases in response to any increases in temperature regardless of variations in the level of the power supply voltage, wherein the load includes:

a first resistor, first and second NMOS transistors connected serially between the reference voltage generating terminal and the ground voltage, for receiving the reference voltage at a gate of the first NMOS transistor and for receiving the power supply voltage at a gate of the second NMOS transistor; and a first PMOS transistor and a third NMOS transistor connected serially between the reference voltage generating terminal and the ground voltage, for receiving a voltage of a common node of the first resistor and the first NMOS transistor at a gate of the first PMOS transistor and the reference voltage at a gate of the third NMOS transistor.

6. A reference voltage generating circuit as claimed in claim 5, wherein the bias current generating circuit comprises:

a second PMOS transistor and a fourth NMOS transistor connected serially between the power supply voltage and the ground voltage, for receiving a voltage of a first node at a gate of the second PMOS transistor and the start-up voltage at a commonly connected gate and drain of the fourth NMOS transistor; and a third PMOS transistor, a fifth NMOS transistor, and a second resistor connected serially between the power supply voltage and the ground voltage, for receiving the voltage of the first node at a commonly connected gate and drain of the third PMOS transistor and the start-up voltage at a gate of the fifth NMOS transistor, wherein the bias current is generated through the third PMOS transistor.

7. A reference voltage generating circuit as claimed in claim 5, wherein the current generator comprises a fourth PMOS transistor for mirroring the bias current.

* * * * *